US005344662A

United States Patent [19]

Payne et al.

[11] Patent Number: 5,344,662

[45] Date of Patent: Sep. 6, 1994

[54] PRESSURIZED PACKAGE CONTAINING A PARTICULATE PRODUCT EMPLOYING A PRODUCT SEPARATOR TO CONTAIN THE PRODUCT DURING OPENING

[75] Inventors: Michael T. Payne, Wyoming; Daniel J. Kinne, Cincinnati, both of Ohio

[73] Assignee: The Procter & Gamble Company, Cincinnati, Ohio

[21] Appl. No.: 25,530

[22] Filed: Mar. 3, 1993

[51] Int. Cl.[5] ..... B65D 51/16; B65D 85/00

[52] U.S. Cl. ..... 426/124; 426/118; 426/131; 220/374

[58] Field of Search ..... 426/106, 112, 115, 118, 426/131, 392, 395, 397, 124; 220/336, 367, 371–374, 369, 375

[56] References Cited

U.S. PATENT DOCUMENTS

| | | | |
|---|---|---|---|
| 2,915,404 | 12/1959 | Tessmer et al. . | |
| 3,077,409 | 2/1963 | Baselt | 426/118 |
| 3,105,765 | 10/1963 | Creegan | 426/118 |
| 3,240,383 | 3/1966 | Scholtz . | |
| 3,302,822 | 2/1967 | Edwards . | |
| 3,380,624 | 4/1968 | Lincoln et al. | 426/131 |
| 3,797,694 | 3/1974 | See et al. . | |
| 3,967,746 | 7/1976 | Botkin . | |
| 4,318,494 | 3/1982 | Heyn . | |
| 4,399,159 | 8/1983 | Guibert . | |
| 4,545,498 | 10/1985 | Schmid . | |
| 4,756,443 | 7/1988 | Murayama . | |
| 4,830,214 | 5/1989 | Curliss et al. . | |
| 4,902,521 | 2/1990 | Rosenfeld . | |
| 4,921,712 | 5/1990 | Malmquist . | |
| 4,928,845 | 5/1990 | Doyle . | |
| 4,966,780 | 10/1990 | Hargraves et al. . | |
| 4,990,345 | 2/1991 | Webb . | |
| 5,103,990 | 4/1992 | Irwin . | |
| 5,121,858 | 6/1992 | Chong . | |

FOREIGN PATENT DOCUMENTS 3-124579 5/1991 Japan .

OTHER PUBLICATIONS

Ser. No. 7,957,570, Wade K. Daniel, Oct. 7, 1992.

*Primary Examiner*—Michael W. Ball
*Assistant Examiner*—Richard Crispino
*Attorney, Agent, or Firm*—Dean L. Garner

[57] ABSTRACT

A package containing a particulate product under pressure which automatically releases the pressure upon opening with an ordinary can opener, while preventing escape of the particulate material. The package is made up of a container having a closed top and a closed bottom which are connected to a body portion to define a gas tight interior compartment. The container has an inwardly directed bead along the perimeter of the body of the container located at a predetermined distance from the top. A non-porous product separator is placed within the container above the bead so that its perimeter is adjacent to the perimeter of the body of the container. The separator divides the interior compartment into a product chamber, below the separator, and a product free chamber above the separator. The distance from the bead to the top of the container is such that rocking of the separator with respect to the vertical axis of the container is prevented to the extent that the particulate product is prevented from migrating around the separator and into the product-free chamber before and during opening.

21 Claims, 7 Drawing Sheets

PRESSURIZED PACKAGE CONTAINING A PARTICULATE PRODUCT EMPLOYING A PRODUCT SEPARATOR TO CONTAIN THE PRODUCT DURING OPENING

FIELD OF THE INVENTION

The present invention relates to packages for particulate material. The present invention has further relation to packaging such particulate material under pressure.

The present invention has further relation to such packaging of particulate material under pressure wherein the package prevents the uncontrolled emission of the particulate material from the package when the package is initially opened.

The present invention has further relation to such packaging wherein the package lends itself to normal can opener opening.

The present invention has even further relation to the packaging of roast and ground coffee as soon as possible after roasting and grinding without allowing for substantial off gassing.

BACKGROUND OF THE INVENTION

It is well known in the art that fresh roasted coffee gives off substantial amounts of carbon dioxide and other gases, particularly after roasting and grinding. In the past, after the roasting and grinding of the coffee, the roast and ground coffee is usually allowed to set for a period of time sufficient to allow substantial off gassing. The coffee is then placed into a package which is subjected to a vacuum packing operation. The vacuum packing process results in a low level of oxygen in the package head space which is beneficial as oxygen tends to stale the coffee product. Additionally, upon initial opening of the package an influx of air into the package results in an audible signal to the consumer that the product contained within it is fresh. A common package that is used to vacuum pack coffee is a cylindrical tin plated steel stock can. The can is easily opened with a common household can opener.

Recently, there has been a desire to package coffee immediately after roasting and grinding without substantial off gassing. Packaging of the coffee immediately after roasting and grinding provides substantial savings in the packaging of the coffee as the coffee does not need to sit in order to off gas. Furthermore, upon opening of a pressurized coffee package the consumer would receive a pleasurable burst of aroma of fresh ground coffee. This burst of aroma is much more noticeable in a pressurized coffee package than in a vacuum packed coffee package. The problem, however, with packaging particulate material, such as roast and ground coffee, under pressure is in containing the particulate material upon the initial opening of the package. For example if an ordinary coffee can was packed under pressure a significant amount of coffee material would begin to emit uncontrollably from the puncture in the can when it is initially opened with a can opener. This uncontrolled emission from the coffee can creates a considerable mess in the surrounding area that it was opened.

One package that is designed to contain particulate material, such as roast and ground coffee, while preventing the uncontrolled emission of coffee from the package upon opening is described in commonly assigned U.S. Pat. No. b 4,966,780 issued to Hargraves et al. on Oct. 30, 1990. Hargraves discloses a semi rigid substantially gas impervious package for roast and ground coffee having a resealable closure. The package disclosed in this reference includes a means to prevent aspiration of the pressurized coffee from the discharge orifice of the container upon initial opening by the consumer. In a particularly preferred embodiment of the Hargraves package, the means comprises a porous filter member secured across either the discharge orifice or the resealable closure.

However, many consumers are so accustomed to the ordinary coffee can that they prefer it over other types of packages. Moreover, the ordinary coffee can provides for a significant cost savings over the Hargraves package. However, as stated above, when the typical coffee can is pressurized, the pressure causes the ground coffee to emit from the puncture in the can when it is opened using a normal can opener. There has, therefore, been a desire to provide a package for containing particulate material under pressure which is much like an ordinary coffee can and can be opened with a common can opener, but which prevent the uncontrolled emission of the coffee from the package upon initial opening.

It is, therefore, an object of the present invention to provide a package for containing particulate material under pressure but which will prevent the uncontrolled emission of particulate material upon initial opening.

It is another object of the present invention to provide such a package that can-be opened with a common can opener.

It is another object of the present invention to provide such a package that appears to consumers to be an ordinary coffee can.

It is another object of the present invention to provide such a package for containing coffee to be packaged immediately after roasting and grinding and before substantial off gassing.

The aforementioned and other objects of the present invention will become more apparent hereinafter.

SUMMARY OF THE INVENTION

In accordance with the present invention there is provided a package for containing a particulate product under pressure. The package exhibits the ability to automatically release the pressure upon opening while substantially preventing the escape of the particulate material from the package during the opening process. The package is made up of a container having a closed top and a closed bottom which are interconnected to one another by a body portion in order to define a substantially gas tight interior compartment for containing the particulate product under pressure. The vertical axis of the container runs from the top to the bottom. The container further includes an inwardly directed bead along substantially the entire perimeter of the body portion of the container located at a predetermined distance the top.

The package further includes a substantially non-porous product separator disposed within the interior compartment of the container above the bead and adjacent the top of the container. The separator has an outermost perimeter which substantially coincides with the innermost perimeter of the body portion of the package. The separator divides the interior compartment into a product chamber located below the separator and a product free chamber located above the separator. The product free chamber is substantially void of particulate product. The predetermined distance from the bead to the top of the container is such that tilting of the separator with respect to the vertical axis of the container is substantially prevented to the extent that the particulate product is substantially prevented from migrating around the separator and into the product-free chamber before and during opening. This is so when the top of the container is initially punctured with a can opener the gas in the package escapes through the puncture by going around the bead, through the interface existing between the separator and the body portion of the container and out through the puncture while the particulate product is substantially prevented from escaping from the package during the opening process.

BRIEF DESCRIPTION OF THE DRAWINGS

While the specification concludes with claims particularly pointing out and distinctly claiming the present invention, it is believed the present invention will be better understood from the following description taken in conjunction with the accompanying drawings in which:

DETAILED DESCRIPTION OF THE INVENTION

Figure 1:
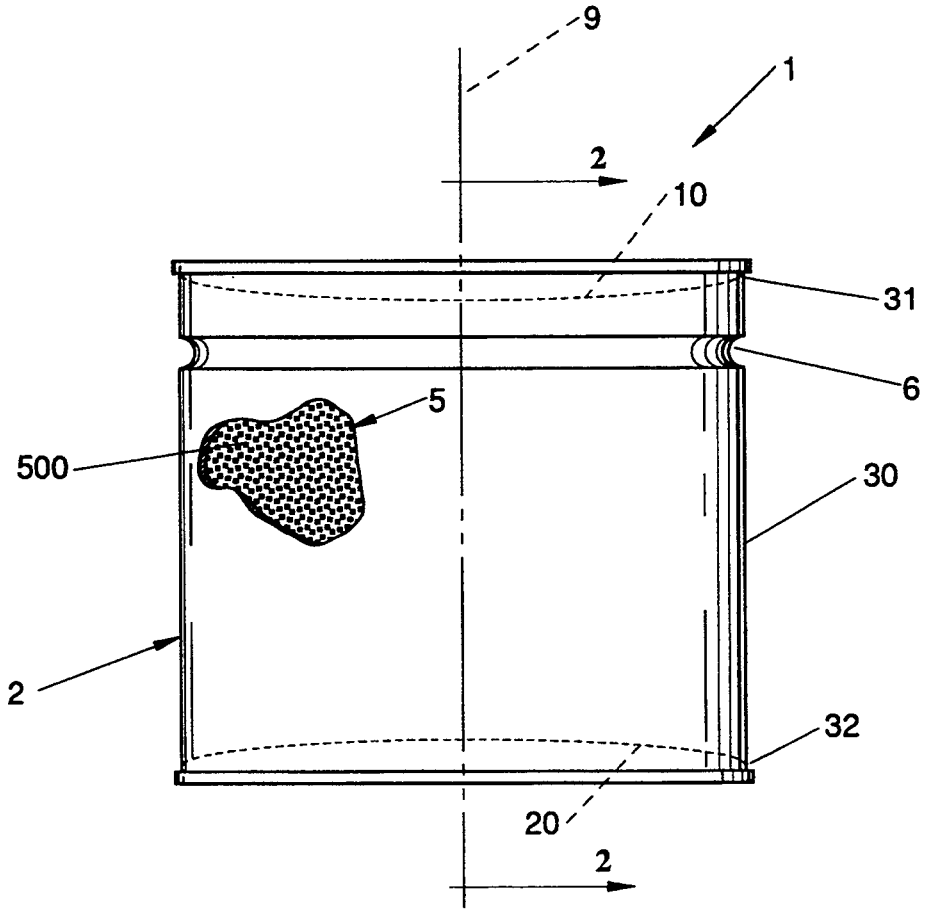
FIG. 1 is an elevational view of the front of the package of the present invention.

Referring to the drawings in detail wherein like numerals indicate the same elements throughout the views there is shown in FIG. 1, an elevational view of a package 1 for containing a particulate product 500, such as roast and ground coffee, under pressure. Package 1 of the present invention can take any number of shape or forms and be made of any number of materials. FIG. 1 shows a preferred embodiment for the package wherein package 1 is a cylindrical can formed from tin plated steel stock. Package 1 will also be referred to as can 1, but it is not intended that the present invention be limited to such cans. Package 1 comprises a container 2, having a closed top 10, a closed bottom 20 and a body portion 30. The top 10 is secured to top 31 of body 30, and the bottom 20 is secured to the bottom 32 of body 30 so as to define a substantially gas impermeable interior compartment 5 for containing a particulate product 500 under pressure. Container 2 further includes an inwardly adjacent bead 6 located a predetermined distance from top 10 of container 2. That predetermined distance will be defined herein as the vertical distance from top 10 at point where it is contacts top 31 of body 30 before the top 10 is secured to the body 30 by mechanical or any other means, to the point where the bead 6 protrudes inwardly at its maximum distance. The vertical axis 9 of package I runs from top 10 to bottom 20.

It is preferred that the top 10 and bottom 20 be disposed concave inwardly towards the compartment 5 so that undesirable deflections of the top 10 and bottom 20 are minimized due to the internal pressure of package 1. If the bottom end expands out too much so that it concaves outwardly, the package 1 will develop what is referred to as a rocker bottom. That is, if bottom 20 deflects outwardly too much, the package 1 will not be stable while resting on a flat surface but will tend to rock back and forth. If the top end 10 deflects outwardly too much, multiple packages will not be stackable on top of one another on a store shelf or the like.

Figure 2:
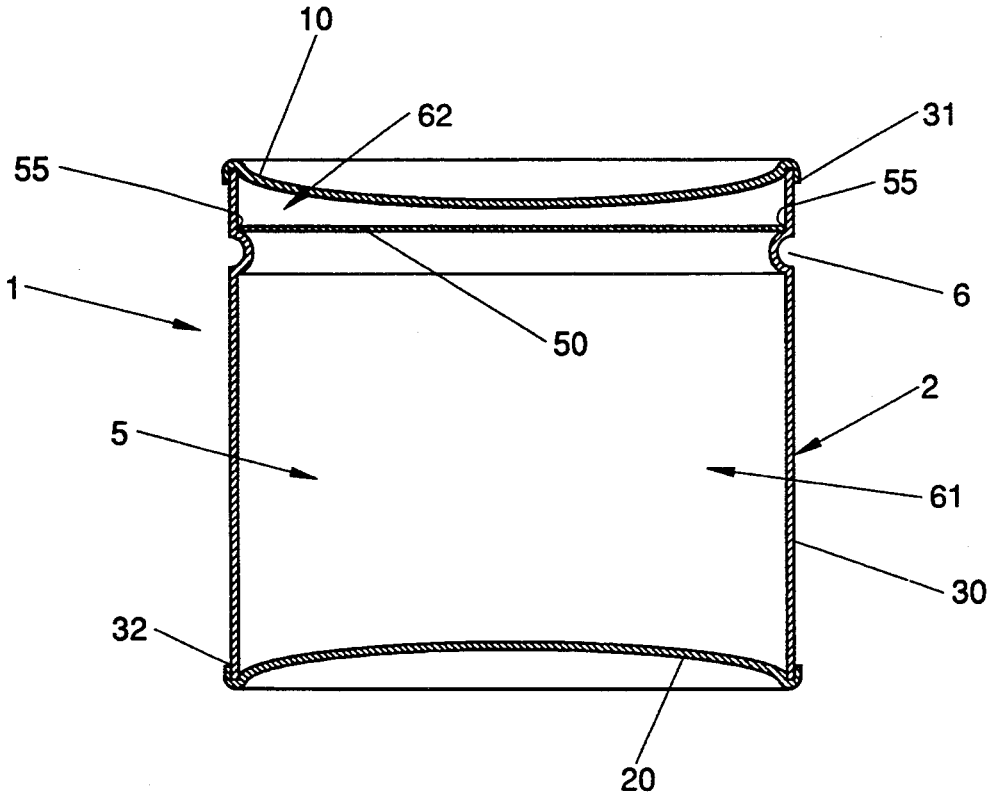
FIG. 2 is a cross-sectional view taken along line 2—2 in FIG. 1, and having the product 500 removed for clarity.

It is believed that the invention can be better understood by referring to FIG. 2 where there is shown a cross-sectional view of package 1 taken along line 2—2 of FIG. 1 and where the product 500 is not shown for clarity. As seen from FIG. 2 one can see that the package of the present invention includes a product separator 50 disposed within the interior compartment 5 of container 2. Separator 50 is located above and rests on bead 6. The outermost perimeter of separator 50 is adjacent to the innermost perimeter of body portion 30. An interface 55 exists between the outermost perimeter of separator 50 and the innermost perimeter of body 30. Separator 50 divides the interior compartment 5 of package 1 into a product chamber 61 located below separator 50, and a product-free chamber 62 located above separator 50. Product-free chamber 62 is preferably substantially void of particulate product 500 before opening. Separator 50 is substantially non-porous and can be made from any number of materials. In a preferred embodiment separator 50 is made from paperboard.

The predetermined distance from the bead 6 to top 10 of container 2 (defined above) is such that when the separator 50 is resting on bead 6 any rocking or tilting movement of separator 50 with respect to the vertical axis g of container 2 is substantially prevented. The rocking movement is limited to the extent that particulate material 500 is substantially prevented from migrating around the separator 50 and into the product-free chamber 62 before and during the opening process. If particulate product is allowed to enter product-free chamber 62, the product in this chamber may emit from the container 2 during the opening process. As stated before, it is undesirable to have any product emitting from the container 2 during opening. However, if the bead 6 is too close to the top 10, thereby placing the separator 50 very close to the top 10, a can opener will interfere and begin to cut the separator 50. This is undesirable in that pieces of separator 50 cut by the can opener could eventually mix with the particulate product and create a mess. Furthermore, if the separator is too close to the top of the package it could interfere with the can opener, and prevent the can opener from opening the package.

When the top 10 is initially punctured with a can opener and the can opener begins to move around the perimeter of top 10, the gas in the package expands. The gas in the product chamber 61 then lifts a portion of separator 50 slightly towards the top 10 of container 2. The gas in the product chamber 61 then flows over bead 6, through interface 55 and through the puncture created by the can opener. While the gas is exiting from the package, as described above, any particulate product that may by travelling with the exiting gas is substantially prevented from escaping from the package through the puncture. It is believed that the particulate material is substantially prevented from escaping from the package because the escaping gas follows a tortuous path when exiting the container 2. Because of the position of the separator 50 and bead 6, the gas cannot follow a linear path when exiting from the package. Instead it must follow a non-linear path around bead 6 and through interface 55. This non-linear path increases the amount of momentum required for particles of product to escape from the container 2 so much so that substantially all of the particulate material does not escape from the container 2 during opening.

In order to better prevent particulate material from escaping from the package during opening it is preferred that the outermost perimeter of separator 50 not fully coincide with the innermost perimeter of body 30. That is interface 55 preferably includes a small gap between the separator 50 and the body 30 of container 2. It is believed that the gap helps to better prevent particulate material from escaping because the velocity of the escaping gas is slowed down as it passes through interface 55. If the gas is slowed down enough the escaping particles will not have enough velocity to escape from the package. This is because the outermost perimeter of the separator 50 is slightly smaller than the innermost perimeter of the body 30 leaving a gap in interface 55. If the surface area of gap of interface 55 is larger than the average initial puncture created by most can openers, the area through which the gas has to escape is governed by the puncture and not the interface 55. This difference in areas slows down the velocity of the escaping gas, thereby slowing down any particles trying to escape with the gas and preventing them from escaping from the package. It is preferable that the surface area of the gap of interface 55 be from about 25% to about 400% larger than the average initial puncture created by most can openers.

Moreover, if the separator is too large, the consumer will have difficulty removing the separator from the container even if the separator includes a handle or other means for easy removal from the can (discussed below). That is, if the diameter is too large a vacuum will be created when the consumer pulls the separator from the can. This will cause the consumer to pull too hard and could result in particulate product from spilling from the container during this removal process.

How large the outermost perimeter of the separator must be with respect to the size of the innermost perimeter of body 30, and how large or small the predetermined distance is from bead 6 to top 10 of container 2, in order to prevent particulate product from entering chamber 62 depends on a number of variables including, but not limited to: the size of the can, the average particle size of the product, the geometry of the can, the pressure in the can, the thickness, stiffness and composition of the separator, and the shape and size of the bead. What is important is that the size of the separator and the predetermined distance from the top 10 to bead 6 is such that the separator 50 is substantially prevented from rocking or tilting with respect to the vertical axis 9 of the container 2 so that particulate product is substantially prevented from entering the product-free chamber 62 before and during opening. During shipping, the package 1 could be dropped or mishandled a number of times so the separator must be able to keep substantially all of the product out of the product-free chamber during this time.

Figure 3:
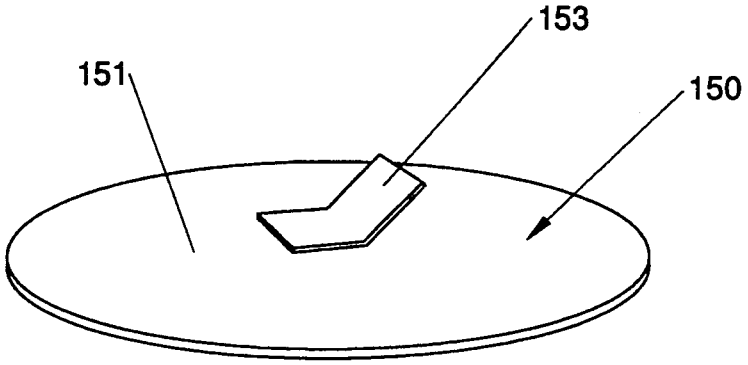
FIG. 3 is a perspective view of an alternative embodiment of a product separator 150 in accordance with the present invention.

In a preferred embodiment the separator includes a means for removing the separator from the container. An example of a means for removing the separator from the container is shown in FIG. 3. This figure shows a perspective view of a separator 150 in accordance with the present invention. Separator 150 includes a handle 153 affixed to side 151 which will be in contact with the product-free chamber. Upon the opening of the package the consumer would grab handle 153 and pull it, thereby lifting the separator 150 from the container. Handle 153 can be made from any number of known materials known in the art including paper and plastic and can be affixed to the separator by any number of methods known in the art. Alternatively, if the separator is made from one or more layers of material secured together, the handle can be formed by cutting out a portion of the top layer and folding it back over.

Figure 4:
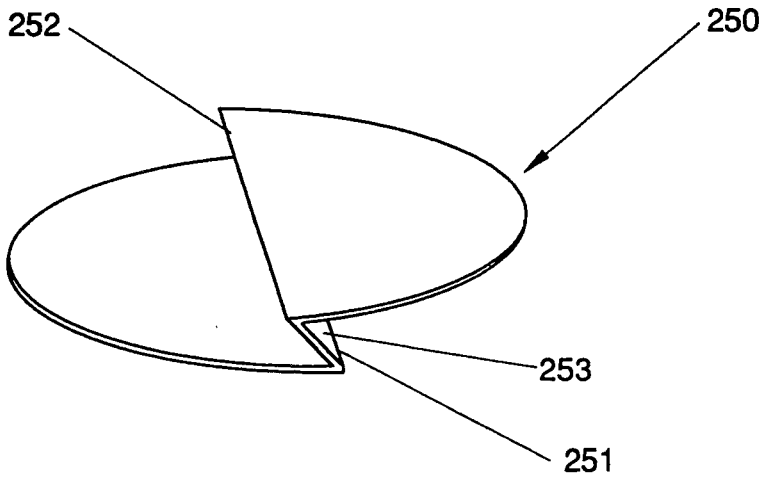
FIG. 4 is a perspective view of another alternative embodiment of a product separator 250 in accordance with the present invention.
Figure 5:
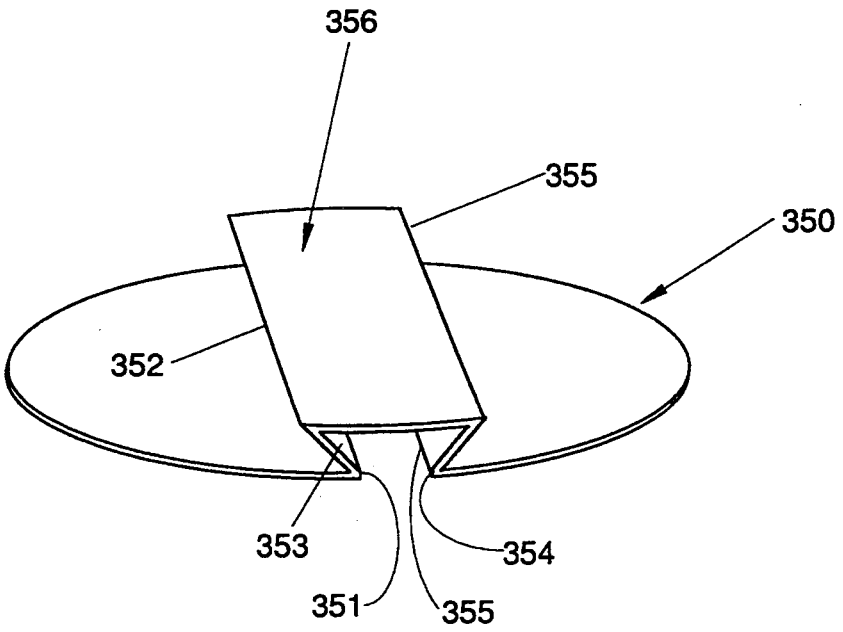
FIG. 5 is a perspective view of yet another alternative embodiment of a product separator 350 in accordance with the present invention.

Another Example of a means for removing the separator from the container is shown in FIG. 4. FIG. 4 shows a perspective view of a separator 250 in accordance with the present invention. Separator 250 starts out being generally elliptical in shape but has two fold lines 251 and 252 that allow handle portion 253 of separator 250 to fold back over on the separator to form a circular shape. To remove the separator the consumer would grab beneath handle 253 and lift it, thereby lifting the separator from the container. Another example of a means for removing the separator from the container, similar in concept to the embodiment shown in FIG. 4, is shown in FIG. 5. FIG. 5 shows a perspective view of a separator 350 in accordance with the present invention. Separator 350 includes 4 fold lines 351, 352, 354 and 355 creating two flap sections 353 and 355 which are folded back onto the separator to create handle 356. After opening the consumer would grab handle 356 and pull it, thereby lifting separator 350 from the container.

It is also preferred that the package I have a means for preventing someone from opening the bottom 20 of container 2. Typically, packages of the type described above can be opened with an ordinary can opener from either the top or the bottom. However, with the package of the present invention it is necessary that the package be opened at the top 10 so that the separator can contain the particulate product. Means for preventing one from opening the bottom of the package are well known in the art and include placing the bottom 20 far enough away from the bottom of the container that an ordinary can opener could not reach the bottom 20 and cut it open. Another means for preventing one from opening the bottom of the container include fabricating the bottom such that it is incompatible with a can opener, such as placing a large the lip on the bottom.

In a particularly preferred embodiment when the top of the container of the present invention is disposed concave inwardly it is preferred that the separator also take on a curved or conical shape. This embodiment can best be shown by referring to FIG. 6 where there is shown a cross-sectional view, similar to that of FIG. 2, of package 401 which is a particularly preferred embodiment of the package of the present invention. Package 401 is similar to package 1 and comprises a container 402, having a closed top 410, a closed bottom 420 and a body portion 430. The top 410 is secured to top 431 of body 430, and the bottom 420 is secured to the bottom 432 of body 430 so as to define a substantially gas impermeable interior compartment 405 for containing a particulate product under pressure. Container 402 further includes an inwardly adjacent bead 406 located a predetermined distance from top 410 of container 402. That predetermined distance is the vertical distance from top 410 at the point where contacts top 431 of body 430, before top 410 is secured to the body 30, to the point where the bead protrudes inwardly at its maximum distance. Bead 406 has a generally flat profile along its upper side. The vertical axis 409 of package 401 runs from top 410 to bottom 430.

Figure 6:
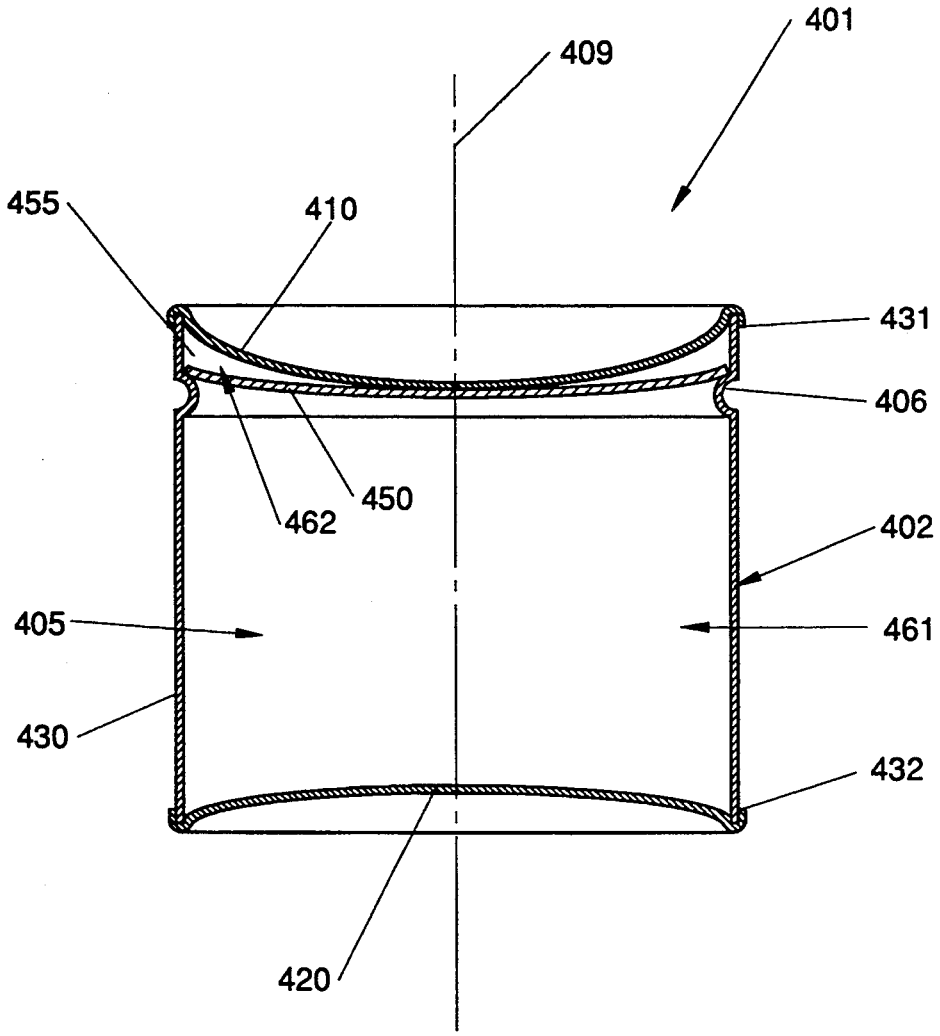
FIG. 6 is a cross-sectional view similar to that of FIG. 2, showing a preferred embodiment for the package of the present invention.

As seen from FIG. 6 one can see that package 401 includes a inwardly concave product separator 450 disposed within the interior compartment 405 of container 402. Separator 450 is located above and rests on bead 406. An interface 455 exists between the outermost perimeter of separator 450 and the innermost perimeter of body 430. The outermost perimeter of separator 450 does not fully coincide with the innermost perimeter of body portion 430 so that a small gap exists in interface 455. Separator 450 divides the interior compartment 405 of package 1 into a product chamber 461 located below separator 450, and a product-free chamber 462 located above separator 450. Product-free chamber 462 is preferably substantially void of particulate product before opening. Separator 450 is substantially non-porous and made from paperboard.

It is preferred that when the top of the container is disposed concave inwardly, as with top 410 of package 401, it is preferred that the separator also be disposed concave inwardly as is separator 450. This is because in general it is preferred to make the product-free chamber of the package of the present invention as small as possible. When the product free chamber is smaller, the separator has less room to move around and rotational movement of the separator is limited to a greater extent. This reduces the chance of particulate product from migrating around the separator and into the product-free chamber.

Figure 7A:
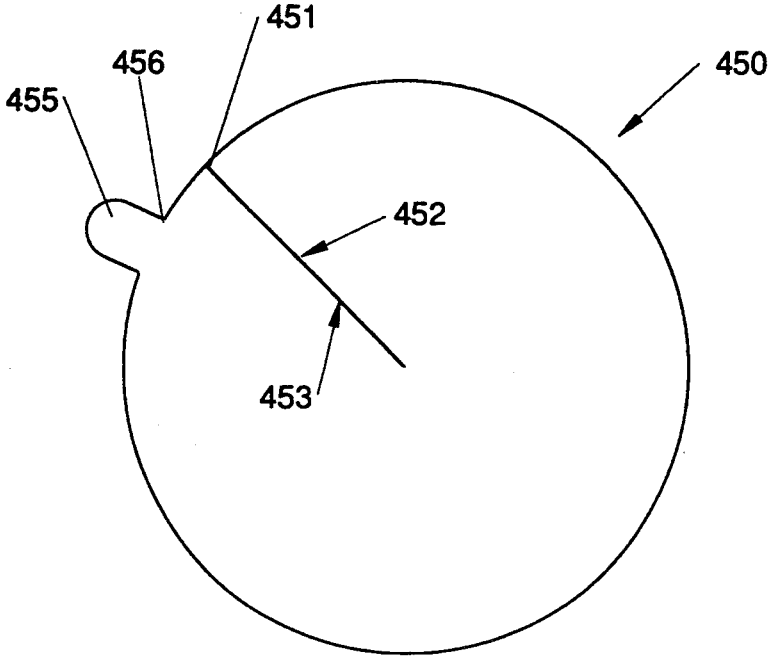
FIG. 7A is a plan view of product separator 450 shown before it has been fully constructed.
Figure 7B:
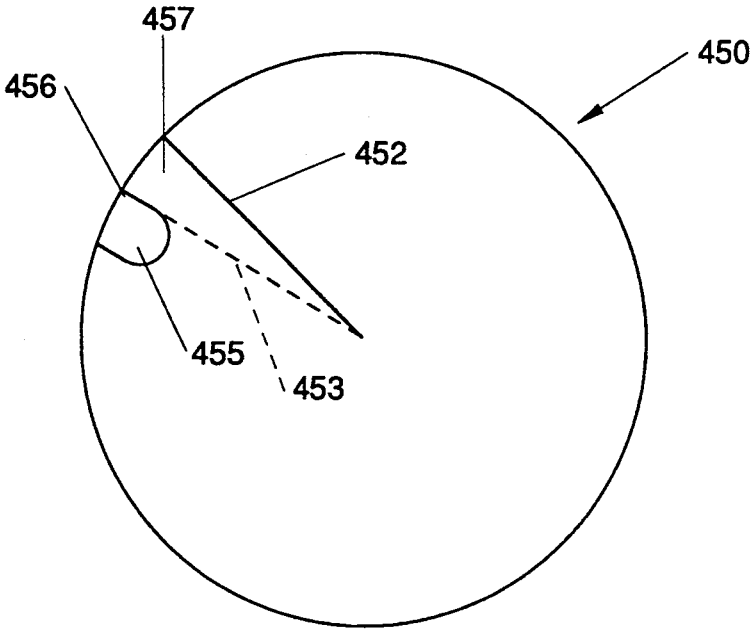
FIG. 7B is a view similar to that of FIG. 7A but showing edge 452 overlapping edge 453.

One way of achieving a curved separator is illustrated in FIGS. 7A–7B. FIG. 7A shows a plan view of a separator 450 in accordance with the present invention. Separator 450 has a slit 451 extending inwardly from its edge to its center. Slit 451 creates edges 452 and 453. Separator 450 also includes an integral tab 455 which is a means for removing the separator from the container. In order to curve separator 450 and give it a conical shape, edge 453 is moved so as to overlap edge 452 as shown in FIG. 7B. When this is done separator 450 takes on a curved or conical shape as shown in FIG. 6. The overlap of edges 452 and 453 should be great enough to prevent particulate material from migrating through the slit and into the product-free chamber before and during opening. In a preferred embodiment edge 453 is moved so that it lines up with closest edge 456 of tab 455 as shown in FIG. 7B. This arrangement will give the best sealing effect in preventing the particulate material from entering the product-free chamber.

As mentioned above outermost perimeter of separator 450 does fully coincide with the innermost perimeter of the body 430, leaving a gap in interface 455. Therefore, in order to keep separator 450 concave, it is necessary to have top 410 pressing downwardly on separator 450, as shown in FIG. 6. Moreover, in a preferred embodiment the top 10 presses against separator 450 in such a way that edges 452 and 453 overlap each other so that edge 453 lines up with edge 456 of tab 455. When separator 450 is placed within the container 452 tab 455 is bent inwardly towards the center of the separator 450.

In a preferred embodiment the body of the container of the present invention is what is referred to in the art as a standard 401 tin plated steel stock can which has an inside diameter ranging from about 3.878 in. (9.85 cm.) to about 3.920 in. (9.957 cm.). For this type of container body one can use either flat or domed bottoms which are sealed to the body using a standard seamed end. Either a rounded bead or one that is flat on its top can be used. It is preferred that for this type of container body the bead protrude inwardly at a maximum distance from about 0.062 in. (0.1575 cm.) to about 0.250 in. (0.635 cm.) The predetermined distance from the top of the container to the bead is preferably from about 0.140 in. (0.356 cm.) to about 0.500 in. (1.27 cm.). The diameter of the separator for this type of container body is preferably greater than 3.780 in. (9.601 cm.).

Any number of materials can be used to form the separator of the above described standard 401 tin plated steel stock can. Some preferred materials known in the art include SBS, SUS or coated laminated paperboard or paper. If paper or paperboard is used it preferably has a thickness ranging from about 0.007 in. (0.019 cm.) to about 0.022 in. (0.056 cm.). If single flute corrugated paperboard is used it preferably has a thickness ranging from about 0.065 in. (0.165 cm.) to about 0.155 in. (0.394 cm.) Other materials that can be used are polyethylene, styrene or butyrate ranging from about 0.010 in. (0.025 cm.) to about 0.030 in. (0.076 cm.).

While particular embodiments of the present invention have been illustrated and described, various modifications will be apparent to those skilled in the art without departing from the spirit and scope of the present invention. Moreover, the ranges of dimensions for the package and its components given above are only preferred ranges and not absolute limits. Accordingly, the scope of the present invention should be considered in terms of the following claims and is understood not to be limited to the details described and shown in the specification and drawings.

What is claimed is:

1. A package containing a particulate product under pressure, said package exhibiting the ability to automatically release said pressure upon opening while substantially preventing the escape of said particulate material from said package during the opening process, said package comprising:

a) a container having a closed top and a closed bottom interconnected to one another by a body portion to define a substantially gas tight interior compartment containing said particulate product under pressure, said vertical axis of said container running from said top to said bottom, said container further including an inwardly directed bead along substantially the entire perimeter of said body portion, said bead being located at a predetermined distance below said top of said container; and b) a substantially non-porous product separator disposed within said interior compartment above said bead and adjacent said top of said container, said separator having an outermost perimeter adjacent to the innermost perimeter of said body portion of said package creating a tortuous path around said separator, said separator dividing said interior compartment into a product chamber located below said separator and a product-free chamber located above said separator, said product-free chamber being substantially void of said particulate product, said predetermined distance from said bead to said top of said container being such that any rocking movement of said separator with respect to the vertical axis of said container is substantially prevented to the extent that said particulate material is substantially prevented from migrating around said separator and into said product-free chamber before and during opening, whereby when said top of said container is initially punctured with a can opener the gas in said package escapes through said puncture by going around said bead, through the interface existing between said separator and said body portion of said container and out through the puncture while said particulate product is substantially prevented from escaping from said package during the opening process.

2. The package according to claim 1 wherein said top and said bottom of said container are disposed concave inwardly.

3. The package of claim 1 wherein said product separator includes a means for removing the separator from the container after opening.

4. The package of claim 1 wherein the outermost perimeter of said separator does not fully coincide with the innermost perimeter of said body of said container, thereby leaving a gap in said interface existing between said separator and said body portion of said container.

5. The package according to claim 1 wherein said package further includes a means to prevent opening said bottom of said container with an ordinary can opener.

6. The package according to claim 1 wherein said separator is made from paperboard having a thickness from about 0.018 inches to about 0. 022 inches.

7. The package according to claim 1 wherein said container is formed from tin plated steel stock.

8. A package containing a particulate product under pressure, said package exhibiting the ability to automatically release said pressure upon opening while substantially preventing the escape of said particulate material from said package during the opening process, said package comprising:

a) a container having a closed top and a closed bottom interconnected to one another by a body portion to define a substantially gas tight interior compartment containing said particulate product under pressure, said top of said container being disposed concave inwardly, said vertical axis of said container running from said top to said bottom, said container further including an inwardly directed bead along substantially the entire perimeter of said body portion, said bead being located at a predetermined distance below said top of said container; and b) a substantially non-porous product separator disposed within said interior compartment above said bead and adjacent said top of said container, said separator being disposed concave inwardly, said separator having an outermost perimeter adjacent to, but not fully coinciding with the innermost perimeter of said body portion of said package creating a tortuous path around said separator, said separator dividing said interior compartment into a product chamber located below said separator and a product-free chamber located above said separator, said product-free chamber being substantially void of said particulate product, said predetermined distance from said bead to said top of said container being such that any rocking movement of said separator with respect to the vertical axis of said container is substantially prevented to the extent that said particulate material is substantially prevented from migrating around said separator and into said product-free chamber before and during opening, whereby when said top of said container is initially punctured with a can opener the gas in said package escapes through said puncture by going around said bead, through the interface existing between said separator and said body portion of said container and out through the puncture while said particulate product is substantially prevented from escaping from said package during the opening process.

9. The package according to claim 8 wherein said bottom of said container is disposed concave inwardly.

10. The package of claim 8 wherein said product separator includes a means for removing the separator from the container after opening.

11. The package according to claim 10 wherein said means for removing the separator from the container after opening comprises an integral tab extending from the outermost perimeter of said separator.

12. The package according to claim 8 wherein said container is generally cylindrical and said separator comprises a circular piece of paperboard having a slit extending outwardly from the center of said separator to its outermost perimeter, said slit forming a first and second edge, said first edge being folded over said second edge so that separator has an inwardly concave and conical shape, said top of said container making contact with said separator so that said separator remains conical within said container before opening.

13. The package according to claim 12 wherein said separator further includes a means for removing the separator from the container after opening, said means comprising an integral tab extending from the outermost perimeter of said separator adjacent said first edge, said first edge thereby being folded over said second edge so that the outermost point of said second edge substantially coincides with a point on the outermost perimeter of said separator where said tab begins to extend outwardly.

14. The package according to claim 8 wherein said package further includes a means to prevent opening said bottom of said container with an ordinary can opener.

15. The package according to claim 8 wherein said separator is made from paperboard having a thickness from about 0.18 inches to about 0.022 inches.

16. The package according to claim 8 wherein said container is formed from tin plated steel stock.

17. A package containing a particulate product under pressure, said package exhibiting the ability to automatically release said pressure upon opening while substantially preventing the escape of said particulate material from said package during the opening process, said package comprising:

a) a generally cylindrical tin plated steel stock container having a closed top and a closed bottom interconnected to one another by a body portion to define a substantially gas tight interior compartment containing said particulate product under pressure, said top and bottom of said container being disposed concave inwardly, said vertical axis of said container running from said top to said bottom, said container further including an inwardly directed bead along substantially the entire perimeter of said body portion, said bead being located at a predetermined distance below said top of said container, and b) a substantially non-pourous paperboard product separator disposed with said interior compartment above said bead and adjacent said top of said container, said separator being disposed concave inwardly, said separator having an outermost perimeter adjacent to, but not fully coinciding with the innermost perimeter of said body portion of said package creating a tortuous path around said separator, said separator further including a means for removing said separator from said container after opening, said separator dividing said interior compartment into a product chamber located below said separator and a product-free chamber located above said separator, said product-free chamber being substantially void of said particulate product, said predetermined distance from said bead to said top of said container being such that any rocking movement of said separator with respect to the vertical axis of said container is substantially prevented to the extent that said particulate material is substantially prevented from migrating around said separator and into said product-free chamber before and during opening, whereby when said top of said container is initially punctured with a can opener the gas in said package escapes through said puncture by going around said bead, through the interface existing between said separator and said body portion of said container and out through the puncture while said particulate product is substantially prevented from escaping from said package during the opening process.

18. The package according to claim 17 wherein said means for removing the separator from the container after opening comprises an integral tab extending from the outermost perimeter of said separator.

19. The package according to claim 18 wherein said separator has a slit extending outwardly from its center to its outermost perimeter, said slit forming a first and second edge, said first edge being folded over said second edge so that said separator has an inwardly concave and conical shape, said top of said container thereby making contact with said separator so that said separator remains conical before opening, said first edge being folded over said second edge so that the outermost point of said second edge substantially coincides with a point on the outermost perimeter of said separator where said tab begins to extend outwardly.

20. The package according to claim 17 wherein said package further includes a means to prevent opening said bottom of said container with an ordinary can opener.

21. The package of claim 17 wherein said body of said container has an inside diameter from about 3.878 inches to about 3.920 inches, said bead protruding inwardly from said body of said container at a maximum distance from about 0.062 inches to about 0.250 inches, said predetermined distance from said top of said container to said bead ranging from about 0.140 inches to about 0.500 inches, and wherein said separator is made from SBS paperboard having a diameter greater than 3.780 inches and a thickness ranging from about 0.018 inches to about 0.022 inches.

* * * * *

UNITED STATES PATENT AND TRADEMARK OFFICE

CERTIFICATE OF CORRECTION

PATENT NO. : 5,344,662

DATED : September 6, 1994

INVENTOR(S) : MICHAEL T. PAYNE ET AL.

It is certified that error appears in the above-identified patent and that said Letters Patent is hereby corrected as shown below:

Column 1, line 66, "No. b" should read -- No. --.

Column 4, line 2, "package I" should read -- package 1 --.

Column 4, line 41, "axis g" should read -- axis 9 --.

Column 6, line 39, "package I" should read -- package 1 --.

Column 11, line 6, "non-pourous" should read -- non-porous --.

Column 11, line 7, "with" should read -- within --.

Signed and Sealed this

Twelfth Day of August, 1997

Bruce Lehman

*Attest:*

BRUCE LEHMAN

*Attesting Officer*

*Commissioner of Patents and Trademarks*